United States Patent [19]

Awad

[11] Patent Number: 4,944,889

[45] **Date of Patent: * Jul. 31, 1990**

[54] LUBRICANT AND SURFACE CONDITIONER FOR FORMED METAL SURFACES

[75] Inventor: Sami B. Awad, Troy, Mich.

[73] Assignee: Henkel Corporation, Ambler, Pa.

[ * ] Notice: The portion of the term of this patent subsequent to Aug. 22, 2006 has been disclaimed.

[21] Appl. No.: 395,620

[22] Filed: Aug. 18, 1989

[51] Int. Cl.[5] ..... C10M 137/04

[52] U.S. Cl. ..... 252/32.5; 252/32

[58] Field of Search ..... 252/32.5, 32

[56] References Cited

U.S. PATENT DOCUMENTS

| | | | |
|---|---|---|---|
| 2,285,853 | 6/1942 | Baxter | 252/32.5 |
| 4,260,499 | 4/1981 | Fein | 252/32.5 |
| 4,601,838 | 7/1986 | Kammann | 252/49.3 |
| 4,710,409 | 12/1987 | Lahaye | 427/421 |

OTHER PUBLICATIONS

"Ethex Chemicals Inc.", Physical Properties, Greenville, S.C., 1968.

"GAF ® Chemicals", Physical Properties, 1968.

*Primary Examiner*—William R. Dixon, Jr.

*Assistant Examiner*—James M. Hunter, Jr.

*Attorney, Agent, or Firm*—Ernest G. Szoke; Wayne C. Jaeschke; Real J. Grandmaison

[57] ABSTRACT

The process of reducing the coefficient of static friction on the outside surface of a metal can by applying thereto a lubricant and surface conditioner for formed metal surfaces, particularly beverage containers, which reduces the coefficient of static friction of said metal surfaces and enables drying said metal surfaces at a lower temperature.

The conditioner is a water-soluble organic material selected from a phosphate ester, alcohol, fatty acid including mono-, di-, tri-, and poly-acids; fatty acid derivatives such as salts, hydroxy acids, amides, esters, ethers and derivatives thereof; and mixtures thereof.

9 Claims, No Drawings

LUBRICANT AND SURFACE CONDITIONER FOR FORMED METAL SURFACES

This is a continuation-in-part of Ser. No. 057,129 6-1-87 now U.S. Pat. No. 4,859,351.

BACKGROUND OF THE INVENTION

1. Field of the Invention:

This invention relates to a lubricant and surface conditioner for formed metal surfaces, and more particularly, to such a lubricant and surface conditioner which improves the mobility of aluminum cans without adversely affecting the adhesion of paints or lacquers applied thereto, and also enables lowering the dryoff oven temperature required for drying said surfaces.

2. Discussion of Related Art:

Aluminum cans are commonly used as containers for a wide variety of products. After their manufacture, the aluminum cans are typically washed with acidic cleaners to remove aluminum fines and other contaminants therefrom. Recently, enviromental considerations and the possibility that residues remaining on the cans following acidic cleaning could influence the flavor of beverages packaged in the cans has led to an interest in alkaline cleaning to remove such fines and contaminants. However, the treatment of aluminum cans generally results in differential rates of metal surface etch on the outside versus on the inside of the cans. For example, optimum conditions required to attain an aluminum finefree surface on the inside of the cans usually leads to can mobility problems on conveyors because of the increased roughness on the outside can surface.

These aluminum can mobility problems are particularly apparent when it is attempted to convey the cans through single filers and to printers. Thus, a need has arisen in the aluminum can manufacturing industry to modify the coefficient of static friction on the outside surface of the cans to improve their mobility without adversely affecting the adhesion of paints or lacquers applied thereto. The reason for improving the mobility of aluminum cans is the general trend in this manufacturing industry to increase production without additional capital investments in building new plants. The increased production demand is requiring can manufacturers to increase their line and printer speeds to produce 20 to 40 percent more cans per unit of time. For example, the maximum speed at which aluminum cans may be passed through a printing station typically is on the average of about 1150 cans per minute, whereas it is desired that such rate be increased to about 1400 to 1500 cans per minute or even higher.

However, thoroughly cleaned aluminum cans by either acid or alkaline cleaner are, in general, characterized by high surface roughness and thus have a high coefficient of static friction. This property hinders the flow of cans through single filers and printers when attempting to increase their line speed. As a result, printer misfeeding problems, frequent jammings, down time, and loss of production occur in addition to high rates of can spoilage.

Another consideration in modifying the surface properties of aluminum cans is the concern that such may interfere with or adversely affect the ability of the can to be printed when passed to a printing or labeling station. For example, after cleaning the cans, labels may be printed on their outside surface as well as lacquers may be sprayed on their inside surface. In such case, the adhesion of the paints and lacquers is of major concern.

In addition, the current trend in the can manufacturing industry is directed toward using thinner gauges of aluminum metal stock. The down-gauging of aluminum can metal stock has caused a production problem in that, after washing, the cans require a lower drying oven temperature in order to pass the column strength pressure quality control test. However, lowering the drying oven temperature resulted in the cans not being dry enough when they reached the printing station, and caused label ink smears and a higher rate of can rejects.

Thus, it would be desirable to provide a means of improving the mobility of aluminum cans through filers and printers to increase production, reduce line jammings, minimize down time, reduce can spoilage, improve ink laydown, and enable lowering the drying oven temperature of washed cans. Accordingly, it is an object of this invention to provide such means of improving the mobility of aluminum cans and to overcome the afore-noted problems.

3. Description of the Invention: Other than in the operating examples, or where otherwise indicated, all numbers expressing quantities of ingredients or reaction conditions used herein are to be understood as modified in all instances by the term "about".

In accordance with this invention, it has been found that a lubricant and surface conditioner applied to aluminum cans after washing enhances their mobility and improves their water film drainage and evaporation characteristics as to enable lowering the temperature of a drying oven by from about 25 to about 100° F. without having any adverse effect on the label printing process. The lubricant and surface conditioner reduces the coefficient of static friction on the outside surface of the cans enabling a substantial increase in production line speeds, and in addition, provides a noticeable improvement in the rate of water film drainage and evaporation resulting in savings due to lower energy demands while meeting quality control requirements.

More particlarly, in accordance with this invention, it has been found that application of a thin organic film to the outside surface of aluminum cans serves as a lubricant inducing thereto a lower coefficient of static friction, which consequently provides an improved mobility to the cans, and also increases the rate at which the cans may be dried and still pass the quality control column strength pressure test. It has also been found that the improved mobility and drying rate of the cans depends on the thickness or amount of the organic film, and on the chemical nature of the material applied to the cans.

The lubricant and surface conditioner for aluminum cans in accordance with this invention may be selected from water-soluble alkoxylated surfactants such as organic phosphate esters; alcohols; fatty acids including mono-, di-, tri-, and poly-acids; fatty acid derivatives such as salts, hydroxy acids, amides, esters, ethers and derivatives thereof; and mixtures thereof.

The lubricant and surface conditioner for aluminum cans in accordance with this invention preferable comprises a watersoluble derivative of a saturated fatty acid such as an ethoxylated stearic acid or an ethoxylated isostearic acid, or alkali metal salts thereof such as polyoxyethylated stearate and polyoxyethylated isostearate. In addition, the lubricant and surface conditoner for aluminum cans may comprise a water-soluble alcohol having at least about 4 carbon atoms and may contain up to about 50 moles of ethylene oxide. Excellent results have been obtained when the alcohol comprises polyoxyethylated oleyl alcohol containing an average of about 20 moles of ethylene oxide per mole of alcohol.

Further, the lubricant and surface conditioner for aluminum cans in accordance with this invention may comprise a phosphate acid ester or preferably an ethoxylated alkyl alcohol phosphate ester. Such phosphate esters are commercially available under the tradename Gafac PE 510 from GAF Corporation, Wayne, New Jersey, and as Ethfac 136 and Ethfac 161 from Ethox Chemicals, Inc., Greenville, S.C. In general, the organic phosphate esters may comprise alkyl and aryl phosphate esters with and without ethoxylation.

The lubricant and surface conditioner for aluminum cans may be applied to the cans during their wash cycle, during one of their treatment cycles, during one of their water rinse cycles, or more preferably, during their final water rinse cycle. In addition, the lubricant and surface conditioner may be applied to the cans after their final water rinse cycle, i.e., prior to oven drying, or after oven drying, by fine mist application from water or volatile non-inflammable solvent solution. It has been found that the lubricant and surface conditioner is capable of depositing on the aluminum surface of the cans to provide them with the desired characteristics. The lubricant and surface conditioner may be applied by spraying and reacts with the aluminum surface through chemisorption or physiosorption to provide it with the desired film.

Generally, in the cleaning process of the cans, after the cans have been washed, they are typically exposed to an acidic water rinse. In accordance with this invention the cans may thereafter be treated with a lubricant and surface conditioner comprising an anionic surfactant such as a phosphate acid ester. In such case, the pH of the treatment system is important and generally should be acidic, that is between about 1 and about 6.5, preferably between about 2.5 and about 5. If the cans are not treated with the lubricant and surface conditioner of this invention after the acidic water rinse, the cans are exposed to a tap water rinse and then to a deionized water rinse. In such event, the deionized water rinse solution is prepared to contain the lubricant and surface conditioner of this invention which may comprise a nonionic surfactant selected from the aforementioned polyoxyethylated alcohols or polyoxylated fatty acids. After such treatment, the cans may be passed to an oven for drying prior to further processing.

The amount of lubricant and surface conditioner to be applied to the cans should be sufficient to reduce the coefficient of static friction on the outside surface of the cans to a value of about 1.5 or lower, and preferably to a value of about 1 or lower. Generally speaking, such amount should be on the order of from about 3 $mg/m^2$ to about 60 $mg/m^2$ of lubricant and surface conditioner to the outside surface of the cans.

For a fuller understanding of the invention, reference should be made to the following- examples which are intended to be merely descriptive, illustrative, and not limiting as to the scope of the invention.

EXAMPLE I

This example illustrates the amount of aluminum can lubricant and surface conditioner necessary to improve their free mobility through the tracks and printing stations of an industrial can manufacturing facility, and also shows that the lubricant and surface conditioner does not have an adverse effect on the adhesion of labels printed on the outside surface as well as of lacquers sprayed on the inside surface of the cans.

Uncleaned aluminum cans obtained from an industrial can manufacturer were washed clean with an alkaline cleaner available from the Parker + Amchem Division, Henkel Corporation, Madison Heights, Michigan, employing that company's Ridoline® 3060/306 process. The cans were washed in a laboratory miniwasher 35 processing 14 cans at a time. The cans were treated with different amounts of lubricant and surface conditioner in the final rinse stage of the washer and then dried in an oven. The lubricant and surface conditioner comprised about a 10% active concentrate of polyoxyethylated isostearate, an ethoxylated nonionic surfactant, available under the tradename Ethox MI-14 from Ethox Chemicals, Inc., Greenville, S.C. The treated cans were returned to the can manufacturer for line speed and printing quality evaluations. The printed cans were divided into two groups, each consisting of 4 to 6 cans. All were subjected for 20 minutes to one of the following adhesion test solutions:

Test Solution A; 1% Joy® (a commercial liquid dishwashing detergent, Procter and Gamble Co.) solution in 3:1 deionized water: tap water at a temperature of 180° F.

Test Solution B; 1% Joy® detergent solution in deionized water at a temperature of 212° F.

After removing the printed cans from the adhesion test solution, each can was cross-hatched using a sharp metal object to expose lines of aluminum which showed through the paint or lacquer, and tested for paint adhesion. This test included applying Scotch (Scotch is a registered trademark of the 3M Company) transparent tape No. 610 firmly over the crosshatched area and then drawing the tape back against itself with a rapid pulling motion such that the tape was pulled away from the cross-hatched area. The results of the test were rated as follows: 10, perfect, when the tape did not peel any paint from the surface; 8, acceptable; and 0, total failure. The cans were visually examined for any print or lacquer pick-off signs.

In addition, the cans were evaluated for their coefficient of static friction using a laboratory static friction tester. This device measures the static friction associated with the surface characteristics of aluminum cans. This is done by using a ramp which is raised through an arc of 90° by using a constant speed motor, a spool and a cable attached to the free swinging end of the ramp. A cradle attached to the bottom of the ramp is used to hold 2 cans in horizontal position approximately 0.5 inches apart with the domes facing the fixed end of the ramp. A third can is laid upon the 2 cans with the dome facing the free swinging end of the ramp, and the edges of all 3 cans are aligned so that they are even with each other.

As the ramp begins to move through its arc a timer is automatically actuated. When the ramp reaches the angle at which the third can slides freely from the 2 lower cans, a photoelectric switch shuts off the timer. It is this time, recorded in seconds, which is commonly referred to as "slip time". The coefficient of static friction is equal to the tangent of the angle swept by the ramp at the time the can begins to move.

The average values for the adhesion test and coefficient of static friction evaluation results are summarized in Table 1 which follows:

TABLE 1

| Test No. | Lubricant and Surface Conditioner Concentrate (%/vol.) | Adhesion Evaluation Test Solution | OSW | ISW | ID | Coefficient of Static Friction |
|---|---|---|---|---|---|---|
| 1 | Control (no treatment) | — | — | — | — | 1.42 |
| 2 | 0.1 | B | 10 | 10 | 10 | 0.94 |
| 3 | 0.25 | A | 10 | 10 | 10 | — |
| 4 | 0.5 | B | 9.5* | 10 | 10 | 0.80 |
| 5 | 0.75 | A | 10 | 10 | 10 | 0.63 |
| 6 | 1.0 | B | 10 | 10 | 10 | 0.64 |
| 7 | 2.0 | A | 10 | 10 | 10 | 0.56 |
| 8 | 5.0 | B | 10 | 10 | 10 | 0.55 |
| 9 | 10.0 | A | 9.8* | 10 | 10 | 0.56 |

*Little pick-off was visually noticed on the outside walls, mainly at the contact marks. In Table 1, OSW stands for outside sidewall, ISW stands for inside sidewall, and ID stands for inside dome.

In brief, it was found that the lubricant and surface conditioner concentrate as applied to the cleaned aluminum cans provided improved free mobility to the cans even at very low use concentrations, and it had no adverse effect on either adhesion of label print or internal lacquer tested even at 20 to 100 times the required use concentration to reduce the coefficient of static friction of the cans.

EXAMPLE II

This example illustrates the use of the aluminum can lubricant and surface conditioner of Example I in an industrial can manufacturing facility when passing cans through a printing station at the rate of 1260 cans per minute.

Aluminum can production was washed with an acidic cleaner (Ridoline ®125 CO, available from the Parker + Amchem Division, Henkel Corporation, Madison Heights, Michigan), and then treated with a non-chromate conversion coating (Alodine ® 404). The aluminum can production was then tested for "slip" and the exterior of the cans were found to have a static coefficient of friction of about 1.63. During processing of these cans through a printer station, the cans could be run through the printer station at the rate of 1150 to 1200 cans per minute without excessive "trips", i.e., improperly loaded can events. In such case, the cans are not properly loaded on the mandrel where they are printed. Each "trip" causes a loss of cans which have to be discarded because they are not acceptable for final stage processing.

About 1 ml/liter of aluminum can lubricant and surface conditioner was added to the deionized rinse water system of the can washer which provided a reduction of the static coefficient of friction on the exterior of the cans to a value of 1.46 or a reduction of about 11 percent from their original value. After passing the cans through the printer, it was found that the adhesion of both the interior and exterior coatings were unaffected by the lubricant and surface conditioner. In addition, the printer speed could be increased to its mechanical limit of 1250 to 1260 cans per minute without new problems.

In similar fashion, by increasing the concentration of the aluminum can lubricant and surface conditioner to the deionized rinse water system, it was possible to reduce the coefficient of static friction of the cans by 20 percent without adversely affecting the adhesion of the interior and exterior coatings of the cans. Further, it was possible to maintain the printer speed continuously at 1250 cans per minute for a 24 hour test period.

EXAMPLE III

This example illustrates the use of other materials as the basic component for the aluminum can lubricant and surface conditioner.

Aluminum cans were cleaned with an alkaline cleaner solution having a pH of about 12 at about 105° F. for about 35 seconds. The cans were rinsed, and then treated with three different lubricant and surface conditioners comprising various phosphate ester solutions. Phosphate ester solution 1 comprised a phosphate acid ester (available under the tradename Gafac ® PE 510 from .GAF Corporation, Wayne, New Jersey) at a concentration of 0.5 g/l. Phosphate ester solution 2 comprised an ethoxylated alkyl alcohol phosphate ester (available under the tradename Ethfac ® 161 from Ethox Chemicals, Inc., Greenville, S.C.) at a concentration of 0.5 g/l. Phosphate ester solution 3 comprised an ethoxylated alkyl alcohol phosphate ester (available under the tradename Ethfac ® 136 from Ethox Chemicals, Inc., Greenville, S.C.) at a concentration of 1.5 g/l.

The mobility of the cans in terms of coefficient of static friction was evaluated and found to be as follows:

| Phosphate ester solution | pH | Coefficient of static friction |
|---|---|---|
| 1 | 3.6 | 0.47 |
| 2 | 3.3 | 0.63 |
| 3 | 2.6 | 0.77 |
| None | — | 1.63 |

The aforementioned phosphate ester solutions all provided an acceptable mobility to aluminum cans, but the cans were completely covered with "water-break". It is desired that the cans be free of water-breaks, i.e., have a thin, continuous film of water thereon, because otherwise they contain large water droplets, and the water film is non-uniform and discontinuous. To determine whether such is detrimental to printing of the cans, they were evaluated for adhesion. That is, the decorated cans were cut open and boiled in a 1% liquid dishwashing detergent solution (Joy ®) comprising 3:1 deionized water: tap water for ten minutes. The cans were then rinsed in deionized water and dried. As in Example I, eight cross-hatched scribe lines were cut into the coating of the cans on the inside and outside sidewalls and the inside dome. The scribe lines were taped over, and then the tape was snapped off. The cans were rated for adhesion values. The average value results are summarized in Table 2.

TABLE 2

| Phosphate ester Solution | Adhesion Rating OSW | ISW | ID |
|---|---|---|---|
| control | 10 | 10 | 10 |
| 1 | 9.8 | 6.8 | 1.0 |
| 2 | 9.8 | 10 | 10 |
| 3 | 10 | 10 | 10 |

In Table 2, OSW stands for outside sidewall, ISW stands for inside sidewall, and ID stands for inside dome.

For the control, it was observed that there was no pick-off (loss of coating adhesion) on either the outside sidewall, the inside sidewall or the inside dome of the cans.

For phosphate ester solution 1, it was observed that there was almost no pick-off on the outside sidewall, substantial pick off on the inside sidewall, and complete failure on the inside dome of the cans.

For phosphate ester solution 2, it was observed that there was almost no pick-off on the outside sidewall, and no pick-off on the inside sidewall and no pick-off on the inside dome of the cans.

For phosphate ester solution 3, it was observed that there was no pick-off on the outside sidewall, the inside sidewall, and the inside dome of the cans.

EXAMPLE IV

This example illustrates the effect of the lubricant and surface conditioner of this invention on the water draining characteristics of aluminum cans treated therewith.

Aluminum cans were cleaned with acidic cleaner (Ridoline® 125 CO followed by Alodine® 404 treatment or Ridoline® 125 CO only) or with an alkaline cleaner solution (Ridoline® 3060/306 process), all the products being available from the Parker + Amchem Division, Henkel Corporation, Madison Heights, Michigan, and then rinsed with deionized water containing about 0.3% by weight of the lubricant and surface conditioner of this invention. After allowing the thus-rinsed cans to drain for up to 30 seconds, the amount of water remaining on each can was determined. The same test was conducted without the use of the lubricant and surface conditioner. The results are summarized in Table 3.

TABLE 3

| Drain Time (sec) | Water Remaining (g/can) | |
|---|---|---|
| | DI Water | 0.3% Conditioner |
| 6 | 2.4–3.0 | nd |
| 12 | 2.1–3.5 | 2.8 |
| 18 | 2.2–3.4 | 2.3 |
| 30 | 1.8–3.4 | 2.3 |

It was found that the presence of the lubricant and surface conditioner caused the water to drain more uniformly from the cans, and that the cans remain "water-break" free for a longer time.

EXAMPLE V

This example illustrates the effect of the oven dryoff temperature on the sidewall strength of aluminum cans. This test is a quality control compression test which determines the column strength of the cans by measuring the pressure at which they buckle. The results are summarized in Table 4.

TABLE 4

| OVEN TEMPERATURE (°F.) | COLUMN STRENGTH (PSI) |
|---|---|
| 440 | 86.25 |
| 400 | 87.75 |
| 380 | 88.25 |
| 360 | 89.25 |

It can be seen from Table 4 that at an oven drying temperature of 380° F., a 2 psi increase was obtained in the column strength test compared to the value obtained at 440° F. oven temperature.

The higher column strength test results are preferred and required because the thin walls of the finished cans must withstand the pressure exerted from within after they are filled with a carbonated solution. Otherwise, cans having weak sidewalls will swell and deform or may easily rupture or even explode. It was found that the faster water film drainage resulting from the presence therein of the lubricant and surface conditioner composition of this invention makes it possible to lower the temperature of the drying ovens and in turn obtain higher column strength results. More specifically, in order to obtain adequate drying of the rinsed cans, the cans are allowed to drain briefly before entry into the drying ovens. The time that the cans reside in the drying ovens is typically between 2 and 3 minutes, dependent to some extent on the line speed, oven length, and oven temperature. In order to obtain adequate drying of the cans in this time-frame, the oven temperature is typically about 440° F. However, in a series of tests wherein the rinse water contained about 0.3% by weight of the lubricant and surface conditioner of this invention, it was found that satisfactory drying of the cans could be obtained wherein the oven temperature was lowered to 400° F., and then to 370° F., and dry cans were still obtained.

I claim:

1. The process of reducing the coefficient of static friction on the outside surface of a metal can and enabling the drying of said can at a lower temperature, comprising applying to said can a liquid lubricant and surface conditioner composition consisting essentially of a watersoluble organic material selected from the group consisting of an ethoxylated fatty acid, an alcohol having at least about 4 carbon atoms and containing up to about 20 mole of ethylene oxide per mole of alcohol, and an ethoxylated alkyl alcohol phosphate ester, said composition having a pH of between about 1 and about 6.5, said organic material being applied to said can in an amount sufficient to lower the drying temperature of said can by from about 25 to about 100° F.

2. The process as in claim 1 wherein said alcohol is a polyoxyethylated oleyl alcohol containing an average of about 20 moles of ethylene oxide per mole of alcohol.

3. The process as in claim 1 wherein said ethoxylated fatty acid is selected from the group consisting of an ethoxylated stearic acid, an ethoxylated isostearic acid, and an alkali metal salt thereof.

4. The process as in claim 1 including the step of applying said organic material to said can after said can has been washed.

5. The process as in claim 1 including the step of applying said organic material to said can during a treatment cycle for said can.

6. The process as in claim 1 including the step of applying said organic material to said can during the final water rinse cycle after said can has been washed.

7. The process as in claim 6 wherein said treatment cycle is performed at a pH of between about 1 and about 6.5.

8. The process as in claim 6 wherein said treatment cycle is performed at a pH of between about 2.5 and about 5.

9. The process as in claim 1 wherein the amount of said organic material applied to said can is from about 3 $mg/m^2$ to about 60 $mg/m^2$ of said can surface.

* * * * *